US005426260A

United States Patent [19]

Terashima et al.

[11] Patent Number: 5,426,260

[45] Date of Patent: * Jun. 20, 1995

[54] DEVICE AND METHOD FOR READING SOUND WAVEFORM DATA

[75] Inventors: Yoshiyuki Terashima; Masami Katsui, both of Suwa, Japan

[73] Assignee: Seiko Epson Corporation, Tokyo, Japan

[ * ] Notice: The portion of the term of this patent subsequent to Jul. 7, 2009 has been disclaimed.

[21] Appl. No.: 897,153

[22] Filed: Jun. 11, 1992

Related U.S. Application Data

[60] Division of Ser. No. 652,240, Feb. 5, 1991, Pat. No. 5,127,302, which is a continuation of Ser. No. 321,419, Mar. 9, 1989, abandoned.

[51] Int. Cl.[6] ..... G10H 1/043; G10H 7/04

[52] U.S. Cl. ..... 84/605; 84/629; 84/DIG. 11

[58] Field of Search ..... 84/601, 602, 604, 605, 84/606, DIG. 11, 627–631, 648, 675–677, 663, 664, 702–708

[56] References Cited

U.S. PATENT DOCUMENTS

| | | | |
|---|---|---|---|
| 3,977,290 | 8/1976 | Sakashita | 84/DIG. 11 |
| 4,198,892 | 4/1980 | Gross | 84/DIG. 11 |
| 4,442,748 | 4/1984 | Kaneko et al. . | |
| 4,537,108 | 8/1985 | Shiramizu . | |
| 4,619,174 | 10/1986 | Okumura | 84/DIG. 11 |
| 4,641,563 | 2/1987 | Nagashima | 84/DIG. 11 |
| 4,699,518 | 10/1987 | Tanabe . | |
| 4,805,508 | 2/1989 | Isozaki | 84/DIG. 11 |
| 4,934,239 | 6/1990 | Tsai | 84/675 |
| 5,208,414 | 5/1993 | Yamada | 84/627 |

*Primary Examiner*—Stanley J. Witkowski

*Attorney, Agent, or Firm*—Stroock & Stroock & Lavan

[57] ABSTRACT

A device for reading sound waveform data has a waveform ROM for storing waveform data represented as an amplitude in a time series. Sound waveform data is repeatedly read from the waveform ROM. The reading of a single waveform corresponds to a single period. A scale ROM stores a plurality of frequency dividing ratios. A programmable counter divides a signal having a predetermined frequency in correspondence with a frequency dividing ratio output by the scale ROM and outputing a clock pulse. A counter counts the clock pulses and indicates the addresses of the waveform ROM. The scale ROM changes the frequency dividing ratio data during an arbitrary divided period of intervals in the period for reading the waveform data. During the period for reading the waveform by the counters, the sound waveform read out has a single frequency and accordingly a single period. The waveform reading period is divided into m number of intervals. A particular kth divided period interval between 0 and m is adjusted to a longer or shorter interval than the remaining m−1 period intervals to allow fine adjustment of an average period improving overall period resolution capabilities.

9 Claims, 7 Drawing Sheets

FIG. 1
PRIOR ART
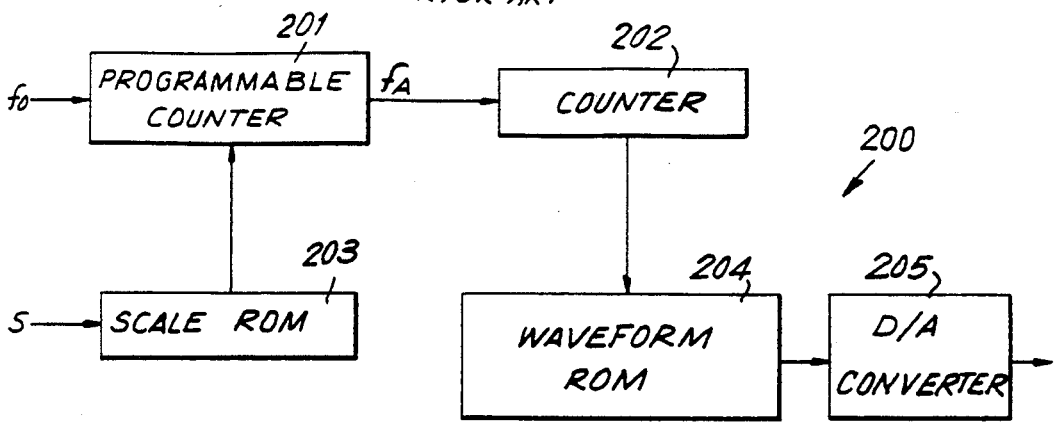
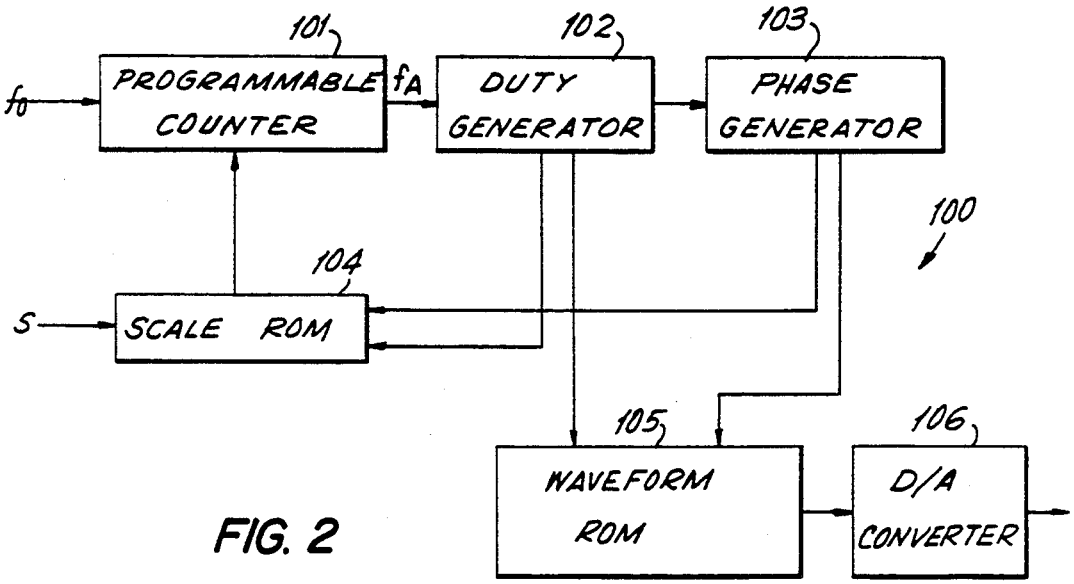
FIG. 2

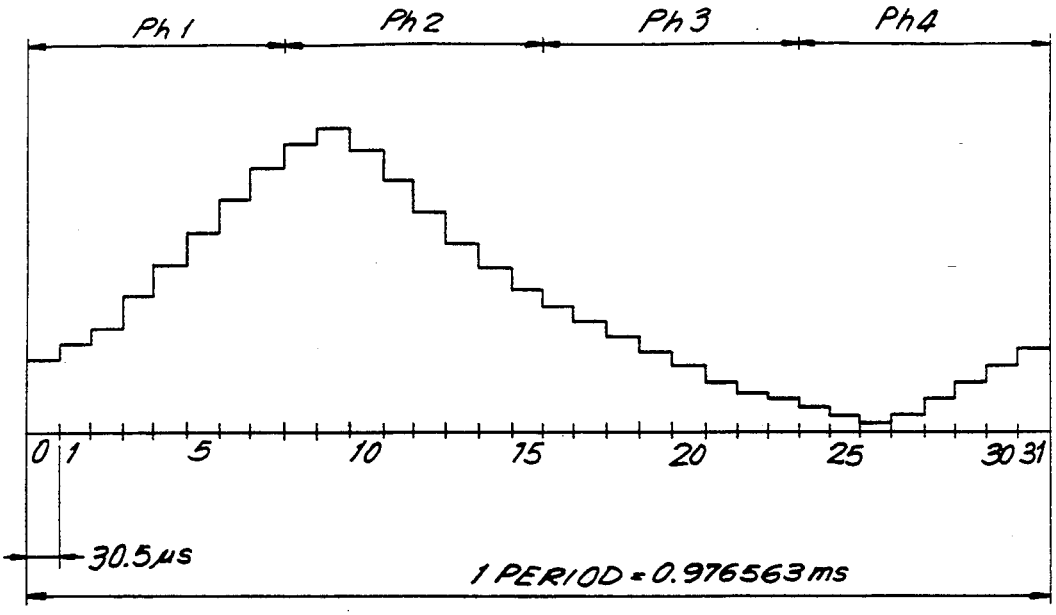
FIG. 3
PRIOR ART
FIG. 4
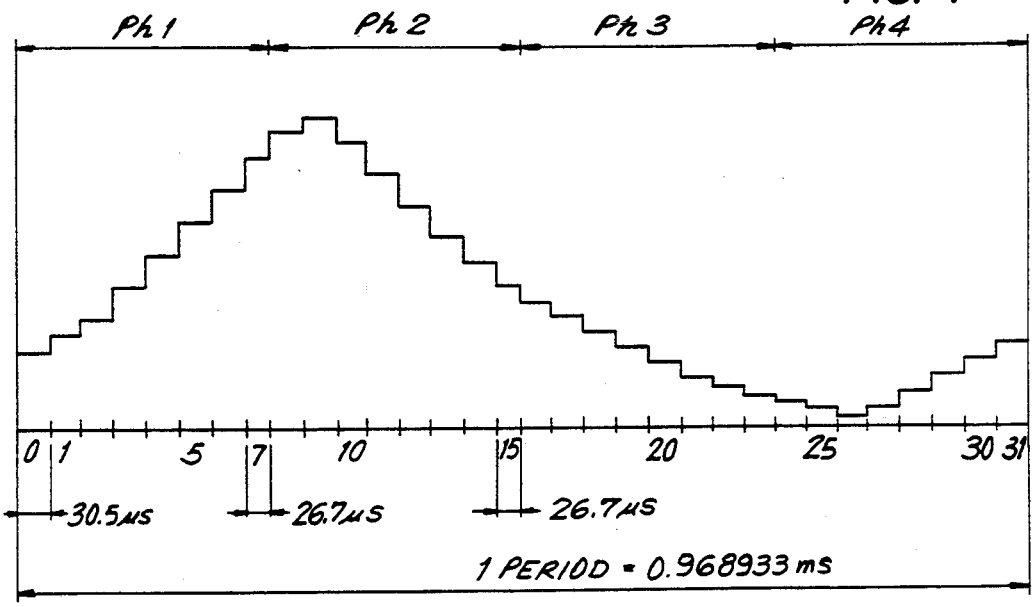

| FREQUENCY DIVIDING RATIO | SCM4 | SCM5 | SCM6 |
|---|---|---|---|
| 10 | 1 | 1 | 1 |
| 9 | 0 | 1 | 1 |
| 8 | 1 | 0 | 1 |
| 7 | 0 | 0 | 1 |
| 6 | 1 | 1 | 0 |
| 5 | 0 | 1 | 0 |
| 4 | 1 | 0 | 0 |
| 3 | 0 | 0 | 0 |

FF7
FF8
FF9
601
SSM
C
Q
$\bar{Q}$
602
603
604
605
606
607
608
609
610
DUTY 0
DUTY 1
DUTY 2
DUTY 3
DUTY 4
DUTY 5
DUTY 6
102
Q0
Q1
Q2

Q2
C
Q
$\bar{Q}$
FF 10
FF11
103
701
702
703
704
Ph1
Ph2
Ph3
Ph4
Q3
Q4

DEVICE AND METHOD FOR READING SOUND WAVEFORM DATA

CROSS REFERENCE TO OTHER APPLICATIONS

This is a division of U.S. patent application Ser. No. 07/652,240 filed on Feb. 5, 1991 now U.S. Pat. No. 5,127,302 which is a continuation of Ser. No. 07/321,419 filed on Mar. 9, 1989, now abandoned.

BACKGROUND OF THE INVENTION

The present invention relates to a device for generating various sound types by reading sound waveforms from a memory, and in particular, to a device for changing the sound frequency during reading of the sound waveform and subjecting the waveform data to digital to analog conversion and supplying the converted data to an electrical acoustic converter and a method for reading the waveform data from the memory.

The musical tone generating circuit of the above mentioned parent application, as shown in FIG. 1, contains a scale ROM 203 containing a plurality of frequency dividing ratios stored at the addresses within the scale ROM 203. The addresses within scale ROM 203 are selected in accordance with an input signal S having a plurality of bits whose contents change in accordance with the length of the musical tone and sound pitch. A programmable counter 201 receives a frequency signal input $f_0$ and divides the frequency in accordance with a frequency division ratio output by scale ROM 203. By selecting different addresses within scale ROM 203 programmable counter 201 variably divides frequency signal $f_0$. Therefore, programmable counter 201 is adapted to variably divide the predetermined frequency in accordance with a frequency dividing ratio output by scale ROM 203. Accordingly, in response to signal $f_0$, program counter 201 outputs a frequency and period, (period being equal to the 1/frequency), corresponding to the sound pitch for a duration corresponding to the sound length.

A waveform ROM 204 stores sound waveform data as N data points. The sound waveform differs in accordance with the tone, such as a violin tone, or a guitar tone. The sound waveform data is preprogrammed in waveform ROM 204 in accordance with the future use of the musical generator and the user's preferences. A counter 202 receives the output from program counter 201 ($f_A$) and counts to a number N. Counter 202 counts N pulses causing counter 202 to read out N addresses from waveform ROM 204 causing the entire waveform stored in ROM 204 to be output to a digital to analog ("D/A") convertor 205. The period for reading one waveform is one period corresponding to the sound pitch. A single waveform is repeatedly read, thereby making it possible to obtain a frequency corresponding to the sound pitch.

Accordingly, in the above musical note generator an S which designates a musical interval. The sound waveform is repeatedly produced by using the frequency of that sound waveform.

In the above musical tone generator, waveform data is stored in ROM and the data is read out at a predetermined repeated frequency. The sound quality of a musical tone produced from waveform data in a ROM changes in accordance with the number of bits in to which the waveform is divided, i.e. divisions along the time axis and in its direction of the amplitude of the waveform as graphed (i.e. the magnitude of resolution). If attention is to be focused on the resolution of the time axis, to increase this resolution in the conventional art it becomes necessary to increase the original frequency by a corresponding margin, i.e. increase the frequency $f_0$ input to program counter 201. By way of example, if the period for reading a single sound waveform is divided into thirty two equal parts along the time axis to obtain an output of 1,024 Hz, the minimum original frequency $f_0$ becomes 32,768 Hz. If vibratos of ±1% are added to the 1,024 Hz output, an original vibration and a program counter having a resolution of 10 Hz becomes necessary. The original vibration $f_0$ satisfies the following formula:

$$\frac{f_0}{32 \times (n-1)} - \frac{f_0}{32 \times n} \leqq 10 \text{ (Hz)}$$

where $f_0$ is an original predetermined frequency and n is a maximum frequency of the program counter. Utilizing this formula, if n=128, then $f_0$=5.2 MHz.

Accordingly, the above musical tone generator suffers from the disadvantage that it becomes necessary to set a maximum divided frequency at a cumbersomely large level. This allows the frequency dividing ratio data for dividing such a high frequency down to a frequency in which 1,024 Hz is shifted by ±1% to be stored in scale ROM 203 and allows programmable counter 201 to effect fine frequency division down to 1,024 Hz±1%. If such a high original frequency such as 5.2 MHz is used, it becomes difficult to incorporate or attach a stable CR oscillator or the like in or outside an integrated circuit. Furthermore, because it becomes necessary to increase the frequency dividing capacity of the program counter, the circuit configuration of the program counter becomes unduly large. Because the oscillation frequency is high, power consumption due to the oscillator and large program counter increases. Accordingly, it is desired to provide a musical tone generator which overcomes the shortcomings of the above musical generator by providing a device and method for reading a stored waveform allowing for vibrato without necessitating an unduly large initial frequency.

SUMMARY OF THE INVENTION

A device for reading a sound waveform includes a first waveform ROM for storing waveform data represented as a waveform having amplitude in a time series. A scale ROM stores a plurality of frequency dividing ratio data and outputs a frequency dividing ratio. A variable frequency dividing counter receives a predetermined input frequency and divides the predetermined input frequency in accordance with the frequency dividing ration output and outputs a clock pulse to sequentially and repeatedly increase the address within the waveform ROM reading out the waveform over a number of period intervals. A counter counts the output of the variable frequency divider. The scale ROM changes the frequency dividing ratio during an arbitrary time interval, changing the length of the time interval during which the waveform is read out.

The device for reading a waveform repeatedly reads a single frequency waveform, each waveform being read in one period. The period of the waveform is divided into m time intervals. An arbitrary kth time interval occurring between 0 and m may be lengthened or shortened relative to the remaining m−1 periods to make fine adjustments of an average time interval to improve overall period resolving capabilities and obtain a vibrato frequency.

Accordingly, it is the object of the instant invention to provide an improved device for reading sound waveform data stored within a musical generator.

Another object of the invention is to provide an improved method for reading sound waveform data stored within a musical tone generator.

Yet another object of the present invention is to provide a sound generator capable of using a low frequency oscillator for obtaining a vibrato frequency requiring a high resolution.

A further object of the present invention is to provide a musical tone generator capable of obtaining a vibrato frequency utilizing a programmable counter having a small circuit configuration.

Still other objects and advantages of the invention will in part be obvious and will in part be apparent from the specification.

The invention accordingly comprises several steps in relation of one or more such steps with respect to each of the others, and the apparatus embodying features of construction, combination of elements and arrangement of parts which are adapted to effect such steps, all as exemplified in the following detailed disclosure and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a block diagram of a musical tone generator constructed in accordance with the parent application;

FIG. 2 is a block diagram of a musical generator constructed in accordance with the invention;

FIG. 3 is a graph of waveform data read out in accordance with the prior art;

FIG. 4 is a graph of waveform data read out in accordance with the present invention;

DETAILED DESCRIPTION OF THE PREFERRED EMBODIMENTS

Figures 5, 6:
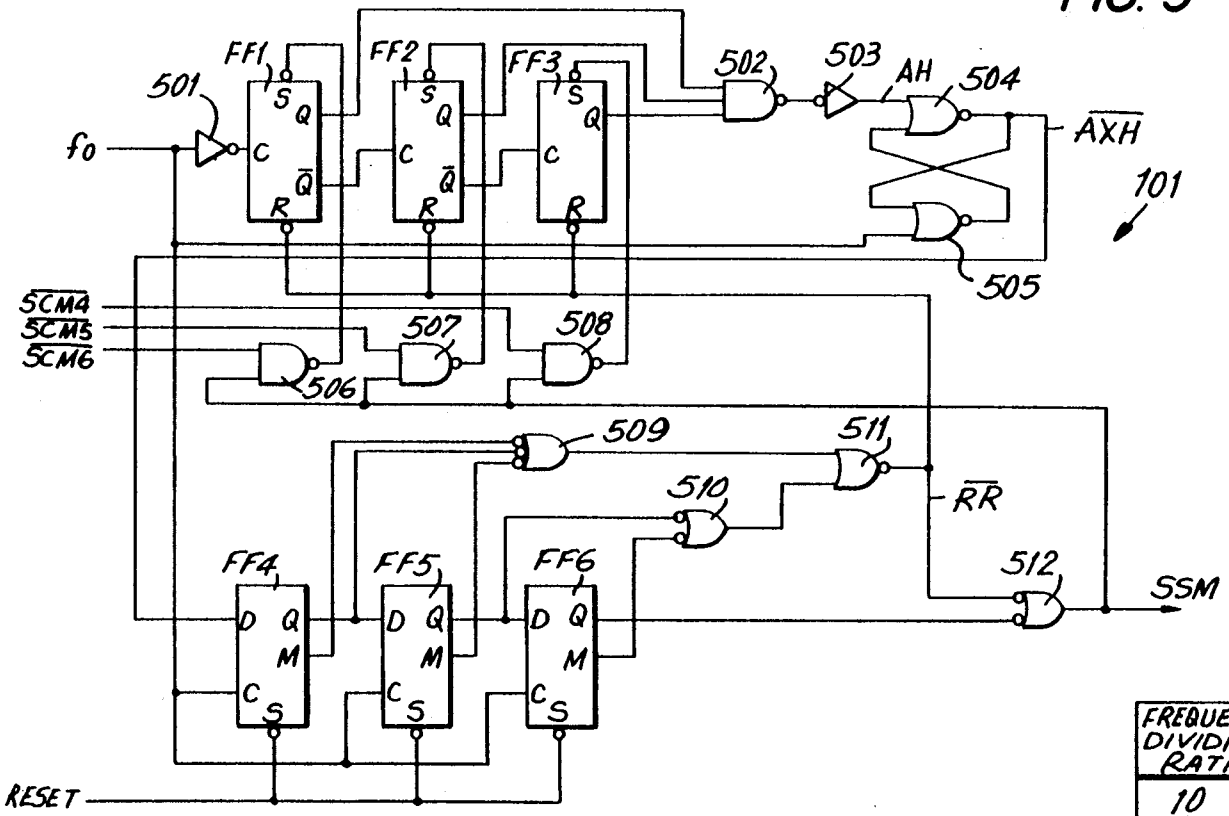
FIG. 5 is a circuit diagram of a programmable counter constructed in accordance with the invention.
FIG. 6 is a table corresponding to the output of a scale ROM constructed in accordance with the invention.

Reference is first made to FIG. 2 wherein a device for reading a sound waveform in a musical tone generator, generally indicated at 100 and constructed in accordance with the invention, is provided. Device 100 includes a programmable counter 101 for variably dividing an input clock signal having a predetermined frequency $f_0$. A scale ROM 104 contains a plurality of frequency dividing ratios which are selected in accordance with an input signal S causing scale ROM 104 to output a frequency dividing ratio to programmable counter 101. Programmable counter 101 divides frequency $f_0$ and outputs a frequency $f_A$ based upon a frequency dividing ratio input from scale ROM 104. A duty generator 102 provides an output to waveform ROM 105 and to a phase generator 103. Phase generator 103 also provides an output to scale ROM 104. A waveform is stored in digital form as N data points in a waveform ROM 105. The sound waveform is read from waveform ROM 105 in accordance with read out signal input from duty generator 102 and phase generator 103. The read out digital waveform is input to a D/A convertor 106 where an output analog signal is later converted into a sound. The frequency $f_A$ is N times as large as a frequency of musical note.

Sound waveform data as illustrated in FIG. 3 is stored in both waveform ROM 105 of FIG. 2 and waveform ROM 204 of FIG. 1. Generally, waveform ROM 105 is accessed at a predetermined frequency in response to the output of programmable counter 101. However, in device 100 of FIG. 2 the output of scale ROM 104 may be changed at the kth count output during the waveform period, while the waveform is being accessed, thereby instantly changing the frequency dividing ratio. k is represented by the following relationship:

$$0 \leqq k \leqq N$$

wherein N is the last count value output by programmable counter 101 within one period of the sound waveform being read out. Therefore, the frequency at which the sound waveform is stored in waveform ROM 105 may be changed at any point within the reading out of the waveform. This arises because the pulses of $f_A$ are instantly converted into pulses having a different period. If waveform ROM 105 is accessed with this new pulse, and that sound waveform is subjected to digital to analog conversion by D/A convertor 106, it becomes possible for a listener to hear the intended sound as if it had a different frequency.

The waveform shown in FIG. 3 also corresponds to the waveform as produced by D/A converter 205 of musical tone generator 200. This waveform occurs when the sound waveform stored in waveform ROM 204 is read out in accordance with the division ratio output by scale ROM 203 when scale ROM 203 receives the input signal S. In this waveform, by way of example, it is assumed that $f_A/N=1{,}024$ Hz and $N=32$. The period T for reading out one waveform equaling $N/f_A$ is its equal to 0.976563 ms.

In comparison, the waveform of FIG. 4 represents the output of the sound waveform of FIG. 3 read out from waveform ROM 105 of device 100. FIG. 4 also represents the output of D/A convertor 106 in accordance with the method described below. The seventh and fifteenth period segments are made shorter than the remaining period segments by $1/f_0$ ($f_0$ equals 262,144 Hz). The frequency of the musical tone in the waveform of FIG. 3, that is $f_A/N$, is 1/0.976563 ms=1,024 Hz. In comparison, the frequency of the musical tone of the waveform in FIG. 4, that is $f_A/N$, is 1/0.968933 ms=1,032 Hz.

The difference between the frequency of the two waveforms is 8 Hz corresponding to approximately 0.8% of 1,024 Hz. Accordingly, in this example, the frequency is elongated by +0.8%. However, if the seventh and fifteenth period intervals are elongated by $1/f_0$, the musical tone frequency becomes 1,016 Hz. If the 1,032 Hz frequency musical tone and the 1,016 Hz frequency musical tone are adjusted by a frequency of several Hz to 10 Hz the output musical tone sounds as if vibratos have been applied to a 1,024 Hz musical tone.

Reference is now made to FIG. 5 wherein a circuit diagram of programmable counter 101 is provided. NOT gate (inverter) 501 receives the predetermined frequency signal $f_0$ and provides an output to a first flip flop FF1 as the flip flop clock input. Flip flop FF1 receives an S (set) input from a NAND gate 506 and provides an output to a second flip flop FF2 as the C (clock) input. Flip flop FF2 receives a set input from a NAND gate 507 and provides a clock input to a third flip flop FF3. Flip flop FF3 receives a set input from a NAND gate 508 and provides a Q output to a NAND gate 502. NAND gate 502 also receives $\overline{Q}$ outputs from flip flops FF1, FF2 and provides an inverted input to inverter 503. Inverter 503 provides an output AH which is received by a NOR gate 504. NOR gate 504 provides an output $\overline{AXH}$ which is input to a second NOR gate 505 which in turn provides an input to NOR gate 504, NOR gates 504 and 505 defining a latch. The second input to NOR gate 505 is $f_0$. The Q outputs of flip flops FF1 and FF2 are connected respectively to the clock inputs of flip flops FF2 and FF3.

A fourth flip flop FF4 receives the $\overline{AXH}$ signal as its D input and the predetermined frequency signal $f_0$ as a clock input and produces a Q output which is applied to a fifth flip flop FF5 as the D input. Flip flop FF5 also receives the frequency signal $f_0$ as a clock input and provides a Q output which is the D input for a sixth flip flop FF6. FF6 provides an M output to OR gate 510. OR gate 510 also receives an inverted input from the M output of an inverted input of flip flop FF5 and provides an output to a NOR gate 511 which outputs a signal $\overline{RR}$. NOR gate 511 receives a second input from OR gate 509 which receives M and Q outputs from flip flop FF4 and the M output of FF5 as inverted inputs. Flip flops FF4, FF5 and FF6 receive a reset input at their respective S (set) inputs. The signal $\overline{RR}$ is applied as an R (reset) input to flip flops FF1, FF2 and FF3.

An OR gate 512 receives the Q output from flip flop FF6 and signal $\overline{RR}$ as inverted inputs and produces a signal SSM which is input to NAND gates 506, 507 and 509. NAND gate 506 also receives as an input the signal $\overline{SCM6}$, NAND gate 507 receives as an input the signal $\overline{SCM5}$ and NAND gate 508 receives as an input the signal $\overline{SCM4}$.

Figures 12, 13:
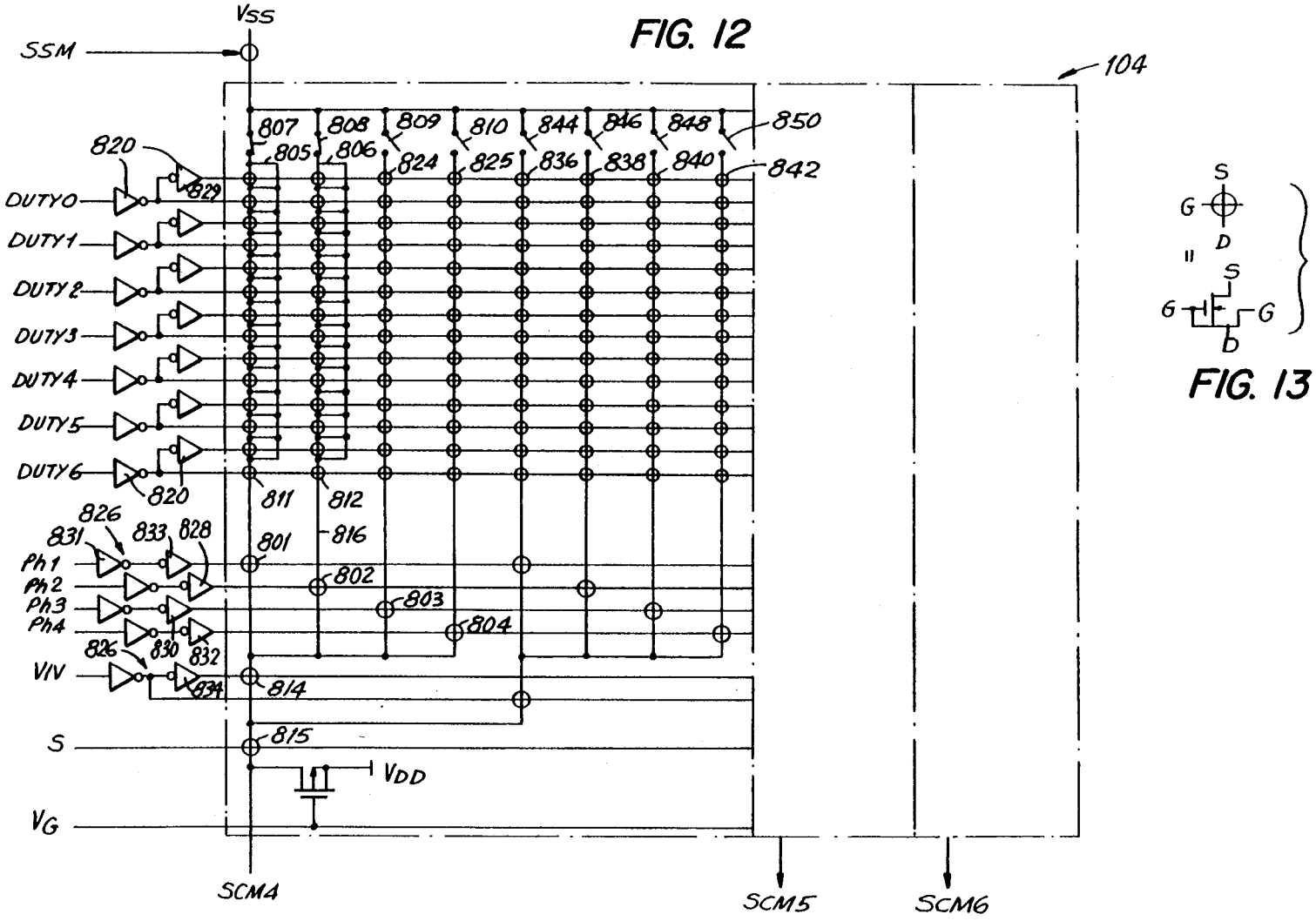
FIG. 12 is a circuit diagram of the scale ROM constructed in accordance with the invention.
FIG. 13 is a schematic representation of a MOS n-channel transistor of the scale ROM of FIG. 12.

The input frequency signal $f_0$ is set at 262,144 Hz. Signals $\overline{SCM4}$ through $\overline{SCM6}$ correspond to data output by scale ROM 104, as shown in FIG. 12, with inverted phases. The frequency dividing ratio of scale ROM 104 is determined by the values of SCM4, SCM5, SCM6 as shown in FIG. 6. For example, when each of the values is equal to 1 the frequency dividing ratio output by scale ROM 104 is 10 and when the value of each of the outputs is 0 the frequency dividing ratio is 3. Accordingly, by changing these signals the frequency dividing ratio output by the by scale ROM 104 may be changed at time intervals within the waveform period to effect frequency fine adjustment in accordance with the invention.

Figure 7:
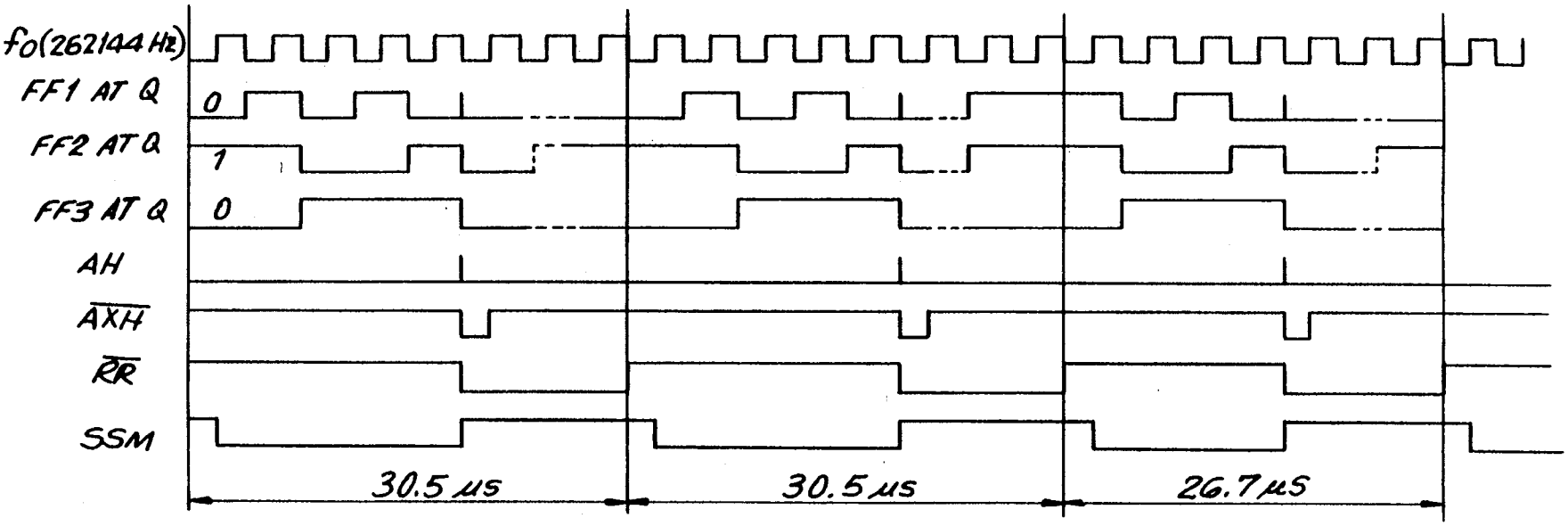
FIG. 7 is a timing chart for the operation of the programmable counter of FIG. 5.

Reference is made to FIG. 7 wherein a timing chart for programmable counter 101 is provided. By way of example, $\overline{SCM4}$, $\overline{SCM5}$, $\overline{SCM6}$ have respective values (1,0,1), i.e. (SCM4, SCM5, SCM6) have values (0,1,0). Flip flops FF1–3 form an up counter and their respective Q terminal outputs change sequentially from (0,1,0), (1,1,0), (0,0,1), (1,0,1), (0,1,1) to (1,1,1). When all three respective Q terminals become 1 NOR gate 503 outputs a spike so that a latch circuit consisting of NOR gates 504, 505 form a pulse $\overline{AXH}$.

The $\overline{AXH}$ signal is delayed by flip flops FF4–6, NAND gates 509, 510 and NOR gate 511 to create a pulse $\overline{RR}$ corresponding to three clock pulses of $f_0$. Additionally, the SSM signal output by NOR gate 512 maintains a high output (H) for a period corresponding to 3.5 clock pulses of $f_0$. When the SSM signal is low (L) a MOS transistor connected to a power source $V_{SS}$ of scale ROM 104 (FIG. 12) is turned off. The MOS transistor is intermittently turned OFF to reduce power consumption to a low level to maintain a continuous current flow to scale ROM 104. On the other hand, scale ROM 104 may be constantly operated, which would allow for the elimination of flip flops FF4–6. Flip flops FF1–3 are reset when signal RR has a low level (L). Counting resumes when $\overline{RR}$ becomes high (H).

During an initial period as shown in FIG. 7, the operating period to complete counting by flip flops FF1–3 corresponds to eight clock pulses of the input frequency $f_0$. One SSM signal is generated during this period. During this first period, the frequency is divided into eight equal time intervals within the period. Because the period of $\overline{RR}$ corresponds to eight clock pulses of $f_0$, the period of $\overline{RR}$ is 30.5 μs and the period of SSM synchronized with $\overline{RR}$ is also 30.5 μs. During the second operating period, the operating period has again been divided into eight equal parts. On the other hand, the third operating period is seven clock pulses long. The frequency has been divided into seven equal parts, not the eight equal parts of the prior two operating periods resulting in a shorter operating period equal to 26.7 μs. The third operating period as shown in FIG. 7 corresponds to the seventh or fifteenth time interval as shown along the abscissa of the waveform presented in FIG. 4.

Programmable counter 101 realizes a change in the frequency dividing ratio. When changing the frequency dividing ratio output by scale ROM 104 input to programmable counter 101, the output data SCM4 through SCM6 of scale ROM 104 are varied to change the initial values of the up counter provided by flip flops FF1–3 and thereby changing the frequency dividing ratio.

During the third operating period as shown in FIG. 7 the input signals (SCM4, SCM5, SCM6) have respective values (0,0,1) resulting in flip flops FF1–3 having respective settings of 1,1,0. This changes the frequency dividing ratio to seven (FIG. 6), in effect shortening the operating period to seven pulse counts of the input signal $f_0$. Accordingly, the counting of the clock signals is effected starting with this operating period thereby the frequency dividing ratio becomes changed. The timing for changing the frequency dividing ratio is controlled by outputs of duty generator 102 and phase generator 103.

Figure 8:
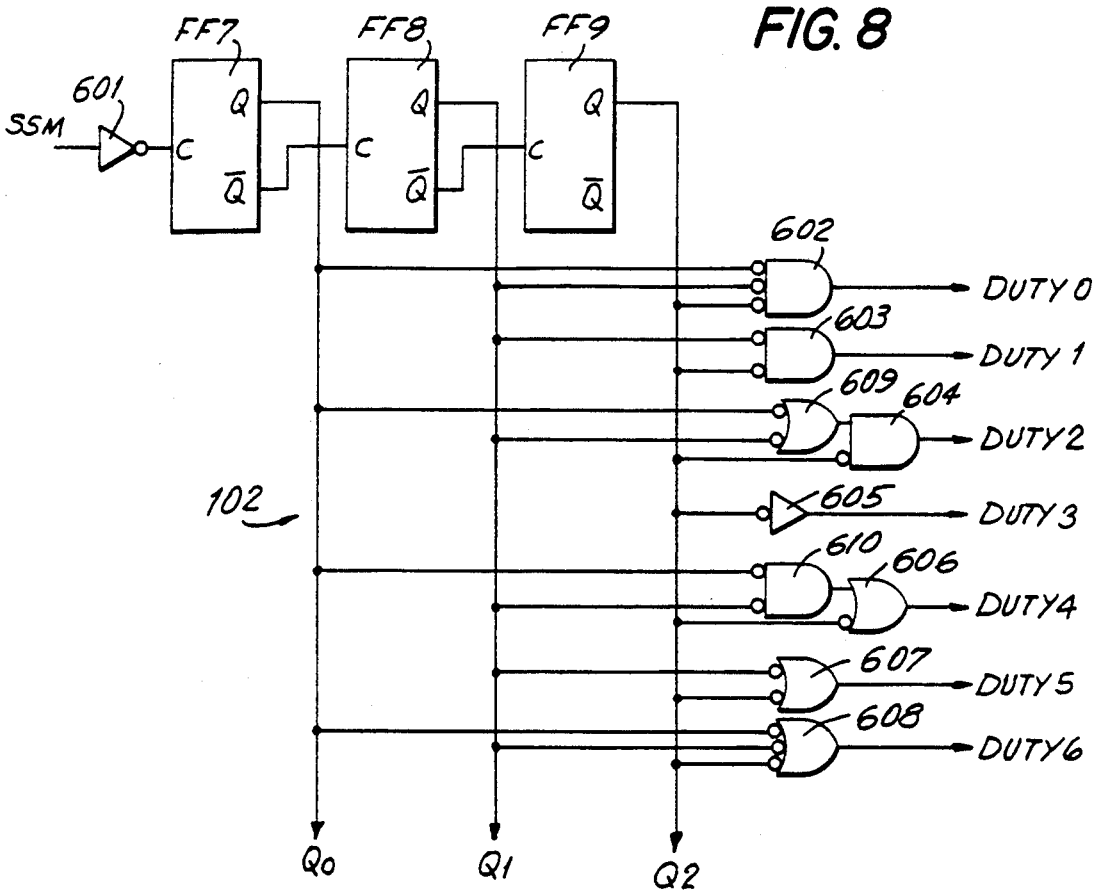
FIG. 8 is a circuit diagram of a duty generator constructed in accordance with the invention.

Reference is now made to FIG. 8. Duty generator 102 generates a series of duty ratios in eight clock pulses of $f_0$ which are utilized for reading the data contained in waveform ROM 105. Duty generator 102 includes flip flops FF7–9 and a plurality of logic gates 602–608 which form seven timing signals, duty 0 to duty 6. The SSM signal is input through a NOT gate (inverter) 601 as a clock input to flip flop FF7. Flip flop FF7 provides a $\overline{Q}$ output as a clock input for flip flop FF8 which in turn provides a $\overline{Q}$ output as a clock input to flip flop FF9. Flip flop FF7 provides its Q output as signal $Q_0$. Flip flop FF8 provides its Q output as signal $Q_1$. Flip flop FF9 provides its Q output as signal $Q_2$.

AND gate 602 receives signals $Q_0$, $Q_1$ and $Q_2$ flip flops FF7, FF8 and FF9 as inverted inputs and produces an output signal duty 0. AND gate 603 receives signals $Q_1$, $Q_2$ as inverted inputs and produces an output signal duty 1. An OR gate 609 receives signals $Q_0$, $Q_1$ as inverted inputs and provides, as an output, one input to AND gate 604 which also receives the signal $Q_2$ as an inverted input to produce signal duty 2. A NOT gate 605 receives the signal $Q_2$ as an input and produces signal duty 3. An AND gate 610 receives signals $Q_0$, $Q_1$ as inverted inputs to provide, as an output, an input to OR gate 606. OR gate 606 also receives signal $Q_2$ as an inverted second input to produce signal duty 4. An OR gate 607 receives signals $Q_1$ and $Q_2$ as inverted inputs to produce signal duty 5. An OR gate 608 receives signals $Q_0$, $Q_1$, $Q_2$ as inverted inputs and produces a signal duty 6.

Signal SSM, the output of programmable counter 101, is passed through flip flops FF7 through FF9 to be subjected to binary frequency division and the outputs of flip flops FF7 through FF9 are decoded by logic gates to generate timing signals duty 0–duty 6.

Figures 9, 11:
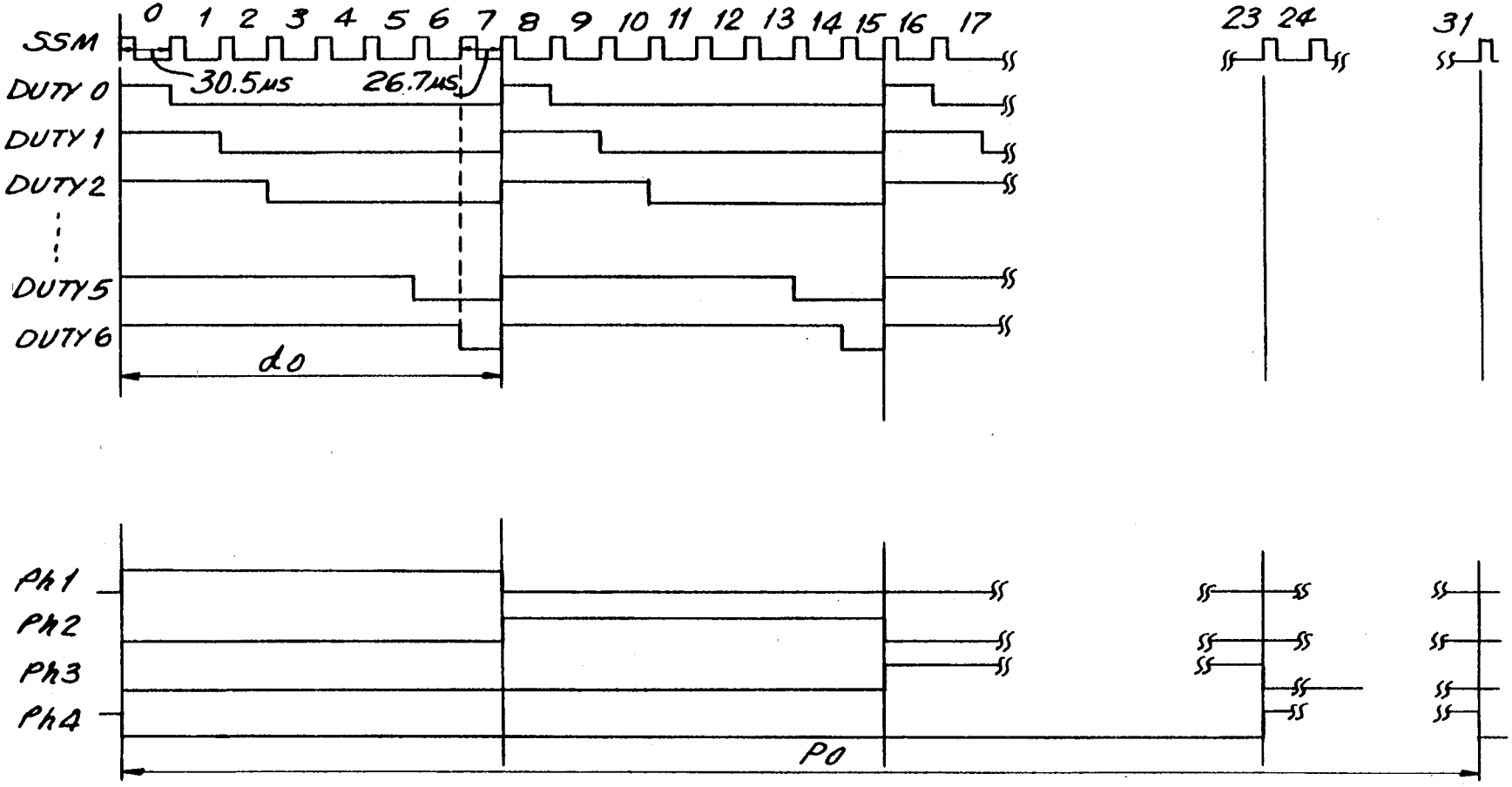
FIG. 9 is a timing chart representing the output of the duty generator of FIG. 8.
FIG. 11 is a timing chart representing the output of the phase generator circuit of FIG. 10.

As can be seen from FIG. 9 when the period $d_0$ is set at one period having a duration of eight SSM pulses, signal duty 0 has a duty ratio of $\frac{1}{8}$, signal duty has a duty ratio 2/8, and so on through signal duty 6 having a duty ratio of 7/8.

For example, the waveform of FIG. 4 is obtained by counting eight equal periods of the frequency $f_0$ during the zero through the sixth time period intervals. During the seventh time period interval the frequency $f_0$ is counted for seven of said equal periods. When it is desired to obtain such a waveform, the data SCM4 through SCM6 read out from scale ROM 104 are changed from values corresponding to a division ratio of eight to values corresponding to a frequency division ratio of seven when the signal duty 6 becomes low.

Figure 10:
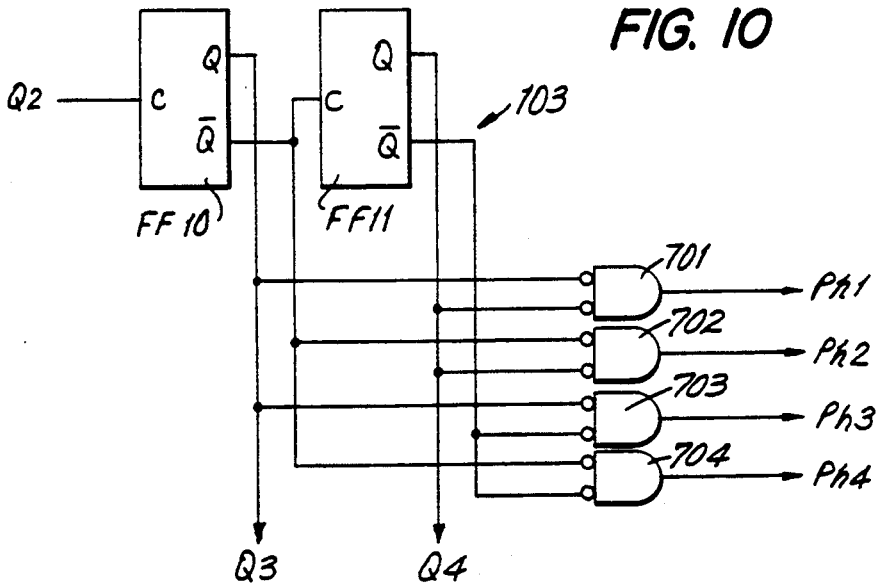
FIG. 10 is a circuit diagram of a phase generator constructed in accordance with the invention.

Reference is now made to FIG. 10 wherein a circuit diagram of phase generator 103 is provided. A flip flop FF10 receives as a clock input signal $Q_2$, which is output by duty generator 102 and provides a Q output $Q_3$ and a Q output, the Q output being applied as a clock signal for flip flop FF11. Flip flop FF11 provides a Q output $Q_4$. An AND gate receives signals $Q_3$ and $Q_4$ as inverted inputs and produces a signal Ph1. An AND gate 702 receives the Q output from flip flop FF10 and signal $Q_4$ as inverted inputs and produces a signal Ph2. An AND gate 703 receives signal $Q_3$ and the Q output from flip flop FF10 and FF11 as inverted inputs to produce signal Ph3. An AND gate 704 receives the Q outputs of flip flop FF10 and Q to produce a signal Ph4.

Flip flops FF10 and FF11 divide a frequency by using signal $Q_2$ output by duty generator 102 as a clock and generates pulses Ph1 through Ph4. If one period is assumed to be $P_0$, the signal Ph1 through Ph4 have the same frequency and duty and only differ in their phases as shown in FIG. 11. The signals Ph1 through Ph4 are the same as signals Ph1 through Ph4 as shown in FIG. 3. The duration during which the respective Ph signals are at a high level correspond to one quarter of the period of a certain musical note. These signals are also used in the timing for reading of scale ROM 104.

Reference is now made to FIGS. 12 and 13 wherein a circuit diagram for scale ROM 104 is provided. Each circle of FIG. 12 represents an n-channel MOS transistor as shown in FIG. 13. Additionally, only the output SCM4 is shown by way of example.

Scale ROM 104 includes a plurality of n-channel MOS transistors arranged in strings of twelve. Transistor strings 822 through 842 are connected to a voltage source $V_{SS}$ by respective switches 807 through 850. Each transistor pair and each transistor string 822 through 842 receives an input of respective duty signals. Accordingly, the first transistor pair in transistor string 822 receives an input of signal duty 0 and the last resistor pair and string 822 receives an input of duty 6. The duty signal is input through a gate pair formed of a NOT gate 827 and an inverter 829. Phase signals Ph1–Ph4 are input through gate pairs 826 which consist of a NOT gate 831 and an amplifier 833 which receives the inverted output of NOT gate 831. The output of each gate pair 826 is output to an individual n-channel MOS transistor 801–804. A VIV signal is input through a gate pair 126 to an n-channel MOS transistor 814 which provides an output to a second n-channel MOS transistor 815 which receives the input signal S and produces an output signal SCM4.

The duty signals duty 0 through duty 6 are input through gate pair 826 to memory cell transistors 811, 812. Normally, data is programmed within scale ROM 104 by wiring so that ON/OFF control of only one MOS transistor is possible with respect to only one row 813, 816. Furthermore, signals in the direction of the respective rows are selected in accordance with phase signals Ph1 through Ph4. Selection is carried out between a high frequency and low frequency by the VIV signal having a vibrato frequency. Additionally, the output of scale ROM 104 is selected by the musical scale data S, an output which is delivered to program counter 101.

By way of example, scale ROM 104 will be explained in accordance with producing the musical note waveform represented in FIG. 4. Assuming that no vibrato is given, signal VIV is high and the right hand portion of the SCM4 signal producing portion of scale ROM 104 is not used. The wiring is set for the data contained in scale ROM 104 as demonstrated by switches 805 through 810. Switches 807 and 808 are set in the ON position while switches 809 and 810 are set in the OFF position. Data is programmed by pre-short circuiting the sources and the drain of each transistor by using metal wires 805 and 806 placed across transistor strings 813, 816 which have been switched to the ON position. Only transistors 811 and 812 are effective transistors with respect to producing SCM4 and inverted signal duty 6 is input to a gate thereof.

During the period when Duty 6 is high, and while the SSM signal in the divided frequency shown in FIG. 4 are between 0 and 6, transistor 811 is set OFF. As a result a transistor string (node) 813 is being charged by a power source $V_{DD}$ through a signal $V_G$ and the data output as signal SCM4 is high (H). This state corresponds to signal SCM4 having a value of 1 as shown FIG. 6 and corresponds to a frequency dividing ratio of eight.

Subsequentially, to set the SSM signal and the frequency dividing ratio to seven, transistor 811 is set to ON and transistor string (node) 813 is discharged so that the output level of SCM4 becomes low (L).

During the period Ph1, transistor 811 is set to the ON state and transistors 814, 815 are also in the ON state and the output level SCM4 becomes low. This corresponds to a 0 output for SCM4 as shown in FIG. 6 which results in a frequency dividing ratio of seven assuming the outputs for SCM5 and SCM6 remain unchanged.

During the time period when signal Ph2 is selected, when the SSM signal and divided frequency correspond to the time intervals eight through fifteen of FIG. 4, the waveform reading operates in a manner similar to that during Ph1. Where signals Ph3 and Ph4 are selected, corresponding to the time period intervals sixteen through thirty one, the frequency dividing ratio returns to eight and switches 809 and 810 are switched OFF so that the output level of SCM4 does not become low. If switches 809, 810 are OFF during Ph3 and Ph4, the output level of SCM4 becomes unconditionally high and the frequency continues to be divided by eight intervals.

When vibratos are to be applied to the musical tone, a clock signal of a vibrato frequency, for example, 4 to 16 Hz, is obtained by dividing the original frequency and is input at VIV.

The average frequency dividing ratio for Ph1 can be expressed as follows:

$$\frac{8 \times 7 + 7 \times 1}{8} = 7.875$$

In the first quarter represented by Ph1, there are seven time intervals extending for eight counts and one time interval extending for seven counts. Accordingly, the average frequency dividing ratio for time period intervals zero through seven is 7.875. Similarly, the average frequency dividing ratio during the period corresponding to Ph2 is equal to 7.875 while the average frequency dividing ratio in the time period corresponding to Ph3, Ph4 is 8. The overall average frequency dividing ratio for reading one waveform ROM 105 may be expressed as follows:

$$\frac{7.875 \times 2 + 8 \times 2}{4} = 7.9375$$

Because two time intervals had an average dividing ratio of 7.875 and the remaining two time intervals had an average frequency dividing ratio of 8, the overall average frequency dividing ratio is 7.9375.

If it is assumed the original frequency $f_0$ is 262,144 Hz, the average frequency for the waveform can be expressed as $$\frac{262144}{7.9375 \times 32} = 1032.06 \text{ Hz}$$

This is a frequency in which +8 Hz is added to a central frequency, 1,024 Hz, to make it possible to have a resolution of approximately 0.8%. Accordingly, it becomes possible to apply the vibratos of ±0.8% with respect to one tone by outputing a frequency of 1,032 Hz while the input signal VIV is high and the frequency of 1,016 Hz while the input signal VIV is low. Accordingly, if the frequency of one tone is 1,024 Hz, the frequency of the tone may be changed to 1,016 Hz and 1,032 Hz within very short time periods in a sound generating apparatus constructed in accordance with the invention so that a vibratory sound may be heard and so that the tone assumes a state in which vibratos may be applied.

It should be noted that the scale ROM 104 shown in FIG. 8 depicts a configuration for generating vibratos of a single tone. If a plurality of tones, such as eight tones, are required as in the case of a musical tone generator, three bit signals S are required and eight configurations are required for producing each of SSM4–SSM 6.

Additionally, flip flops FF7–11 of duty generator 102 and phase generator 103 correspond to counter 202 of the prior art. Waveform ROM 105 is address accessed by output signals $Q_0$–$Q_2$ of duty generator 102 and output signals $Q_3$ and $Q_4$ of phase generator 103. Output signals $Q_0$ through $Q_4$ are decoded by a decoder and incorporated in waveform ROM 105 to select an address and five bit data is output. The capacity of the ROM is 25 by 5, equalling 160 bits.

By providing a scale ROM which provides a variable frequency division ratio in response to a timing signal from a duty generator and a phase generator, it becomes possible to effect a frequency division having a resolution of one or less by changing the frequency dividing ratio of a programmable counter during the operation of a time series. Although the period is instantly offset for a small time duration, the sound is not heard by human ears as being a disturbance of the tone. Additionally, although the above described embodiment is used in a musical tone generator, the present invention may be implemented in speech production and various alarms.

Additionally, it becomes possible to operate the system with a low frequency clock of 262 KHz as compared to the prior art clock having a high frequency of 5.2 MHz. By utilizing a 262 KHz oscillator, the system may use a CR oscillator, reducing the cost of the musical generator as well as reducing power consumption by a factor of twenty, making the device more applicable to battery powered devices.

Furthermore, a small programmable counter may now be used because a pseudo shifted frequency may be obtained by simply changing the frequency dividing ratio data for dividing a frequency into predetermined frequencies to an arbitrary division ratio without using a complex large programmable counter. Additionally, because the output characteristics are improved and because the invention uses a low frequency, a programmable counter is better able to process a radio frequency.

It will thus be seen that the objects set forth above, among those made apparent from the preceding description are efficiently obtained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A method for reading sound waveform data representing amplitude in a time series from a storage device utilizing a counter for reading said sound waveform data, comprising the steps of:

storing a sound waveform in said storage device as waveform data;

said sound waveform having an original frequency corresponding to an original period N, dividing said original period N into m period intervals, the period of each of said m period intervals being equal to each other;

reading said sound waveform data from said storage device by said counter controlling the period of at least one period interval of said m period intervals defining each original period N to be greater or smaller than the remaining period intervals of said each period N to define shifted periods N′ and N″ respectively greater or smaller than N, said waveform data being read and controlled so that successive periods of the output sound waveform alternate between periods N′ and N″, whereby vibrato may be added to said sound waveform.

2. The method of claim 1, further comprising the step of changing at least a second predetermined period interval among said m period intervals to a period interval smaller than or greater than the remaining period intervals.

3. The method for reading sound waveform data of claim 1 wherein said original frequency corresponds to the frequency of a musical scale and shifted periods N′ and N″ correspond to first and second shifted frequencies, further comprising the step of forming said first and second shifted frequencies with respect to each musical scale of a melody, respectively.

4. The method for reading sound waveform data of claim 1, further comprising the step of receiving an input frequency and dividing said input frequency in accordance with a frequency dividing ratio data to generate said m period intervals.

5. The method for reading sound waveform data of claim 4, wherein said counter further includes a variable frequency divider; said variable frequency divider dividing said input frequency to generate said m period intervals.

6. The method for reading sound waveform data of claim 4, further comprising the steps of storing a plurality of said frequency dividing ratio data in a memory device and counting said divided frequency to read said sound waveform data from said storage means.

7. The method for reading sound waveform data of claim 6, further comprising the step of controlling the generating of said m period intervals by changing the frequency dividing ratio output from said memory device in accordance with the count.

8. The method for reading sound waveform data of claim 7, wherein the divided frequency is counted by said counter.

9. A method for reading sound waveform data representing amplitude in a time series from a storage device, comprising the steps of:

receiving an input frequency and dividing said input frequency in accordance with a frequency dividing ratio data to generate m period intervals for reading said sound waveform data;

counting said m intervals and producing a count value;

reading said sound waveform data from said storage device in accordance with said count value;

controlling the generating of said m period intervals by changing the frequency dividing ratio data to divide the input frequency in accordance with said count value produced by counting said m period intervals to change at least one of said period intervals of the divided frequency to one of a longer and shorter period interval than the remaining period intervals;

repeatedly alternately reading said sound waveform data at a first frequency corresponding to a waveform including said longer period interval and a second frequency corresponding to a waveform including said shorter period interval.

* * * * *